US005496646A

United States Patent [19]

Bacigalupo

[11] Patent Number: 5,496,646

[45] Date of Patent: Mar. 5, 1996

[54] INCREASED RETENTION FORCES IN STEEL INTERFERENCE FIT ASSEMBLIES AND METHODS TO INCREASE THE RETENTION FORCES

[75] Inventor: Nelson A. Bacigalupo, Ann Arbor, Mich.

[73] Assignee: NTN Technical Center (U.S.A.), Inc., Ann Arbor, Mich.

[21] Appl. No.: 161,200

[22] Filed: Dec. 2, 1993

Related U.S. Application Data

[63] Continuation of Ser. No. 631,654, Dec. 21, 1990, abandoned.

[51] Int. Cl.[6] ..... C23C 8/12

[52] U.S. Cl. ..... 428/472.2; 148/287; 403/404; 403/345

[58] Field of Search ..... 403/404, 345; 148/287; 428/427.2

[56] References Cited

U.S. PATENT DOCUMENTS

| | | | |
|---|---|---|---|
| Re. 21,903 | 9/1941 | Brenneisen | 29/148 |
| 3,118,711 | 1/1964 | Bachelet | 308/236 |
| 3,328,096 | 6/1967 | Lees | 308/207 |
| 3,428,373 | 2/1969 | Imse | 308/20 |
| 3,535,008 | 10/1970 | Buta | 308/236 |
| 3,697,145 | 10/1972 | Day, Jr. | 308/72 |
| 4,090,746 | 5/1978 | Harkins | 308/26 |
| 4,166,661 | 9/1979 | Hedgcock | 308/207 |
| 4,753,706 | 6/1988 | Vezirian | 29/458 |

OTHER PUBLICATIONS

N. Birks, Introduction to High Temperature Oxidation of Metals, Edward Arnold Press 1983 London.

Oswald Kubasdiewski, Oxidation of Metals and Alloys, Academic Press, New York 1962.

U. K. Evans, Review of Oxidation and Scaling of Heated Solid Metals, 1935 London.

*Primary Examiner*—Sam Silverberg

*Attorney, Agent, or Firm*—Harness, Dickey & Pierce

[57] ABSTRACT

Iron and steel interference fit assemblies with increased retention forces comprised of a purposely formed iron oxide layer of limited thickness on one or both of the mutually engaging surfaces. The new methods to create the new interference fit assemblies comprise heating of iron and steel parts intended for press fit assembly to temperatures substantially between 500° F. (260° C.) and 1050° F. (566° C.) for periods of time in air between ten hours and ten minutes to create an iron oxide surface layer of optimum thickness on at least one of the mutually engaging surfaces prior to assembly. Other methods to generate the optimum thickness of iron oxide layer may also be used. The iron oxide surface layer substantially increases the frictional retention force in the assembly. The retention force effectively doubles with heating at 700° F. (371° C.) to 800° F. (427° C.) for two hours with test results indicating these conditions to be optimal for increasing the frictional retention force. The result is iron and steel interference fit assemblies with substantially increased retention forces.

10 Claims, 1 Drawing Sheet

INCREASED RETENTION FORCES IN STEEL INTERFERENCE FIT ASSEMBLIES AND METHODS TO INCREASE THE RETENTION FORCES

This is a continuation of U.S. patent application Ser. No. 07/631,654, filed Dec. 21, 1990, now abandoned entitled: Increased Retention Forces In Steel Interference Fit Assemblies And Methods To Increase The Retention Forces.

BACKGROUND OF THE INVENTION

The field of the invention pertains to the interference fit assembly of metal products and, in particular, to the interference fit assembly of iron and steel parts such as collars and bearings on shafts although the invention disclosed below is not limited to collars and bearings on shafts.

Iron and steel exposed to an oxidizing environment form an oxide surface layer. Over time the oxiding surface continues to thicken eventually causing the complete oxidation of the metal because the initial oxide layer does not protect the substrate metal from further oxidation. The cross-diffusion of iron and oxygen through the oxide layer permits the substrate metal to oxidize beneath the oxide layer in the vast majority of applications the oxidation of iron and steel is considered very detrimental because of the discoloration, degradation and eventual destruction of the iron or steel product. A purposely formed oxide layer has been disclosed in U.S. Pat. No. Re. 21,903 wherein the oxide layer frictionally resists the untwisting of the inter-twisted ends of wire strapping.

At relatively low temperatures the oxide layer appears to be predominately Haematite ($Fe_2O_3$) and Magnetite ($Fe_3O_4$). However, at relatively high temperatures above 570° C. (1058° F.) according to N. Birks, "Introduction to High Temperature Oxidation of Metals", Edward Arnold Press, London, 1983, pp. 74–75, the oxide layer becomes overwhelmingly Wustite (FeO) with only very thin Haematite and Magnetite films. According to this reference Wustite does not form below 570° C. but reaches 95% of the oxide layer thickness at 1000° C. (1832° F.). Between 400° C. (752° F.) and 570° C. the oxide layer is apparently formed of $\alpha$ $Fe_2O_3$ (rhombohedral structure) and $\gamma$ $Fe_2O_3$ (cubic structure) because the $Fe_3O_4$ oxidizes to form $\alpha$ $Fe_2O_3$. The differing colorations and characteristics of scales formed on iron and steel at various temperatures are a result of the complex chemical and crystal structures formed in the oxide layer.

Numerous mechanical means of retaining collars on shafts have been disclosed historically, such as the means disclosed in U.S. Pat. Nos. 3,118,711; 3,328,096; 3,428,373; 3,535,008; 3,697,145; 4,090,746 and 4,166,661. Such mechanical means all require additional operations and parts which add to manufacturing cost. However, the simplest means of retaining a collar on a shaft remains an interference fit and interference fits remain common means of assembling a variety of mechanically fastened components.

Interference fits rely upon a combination of frictional engagement and squeezing tightness to prevent disassembly in theory the squeezing tightness causes a more intimate contact of the microscopically rough surfaces thereby substantially increasing the force required to overcome the frictional forces opposed to disassembly of the interference fit. Moreover, the more intimate contact of the microscopically rough surfaces increases the number of sites of microscopic welding between surfaces thereby further enhancing the frictional resistance to disassembly.

SUMMARY OF THE INVENTION

The invention comprises iron and steel interference fit assemblies with increased retention forces arising from a purposely formed iron oxide layer of limited thickness on one or both of the mutually engaging surfaces. The invention also comprises specific methods of obtaining the iron oxide surface on at least one of the two interference fit mutually engaging surfaces to thereby substantially increase the retention forces opposed to disassembly. The methods comprise heating an iron or steel part to a specific temperature with the interference fit engaging surface exposed to air or an oxidizing environment and retaining the part at the temperature for a specified length of time. Tests have shown that a two hour treatment at 700° F. to 800° F. (371° C. to 427° C.) in air effectively doubles the retention "force" for AISI 1541 hot rolled and hardened steel, however, a two hour treatment at 900° F. (482° C.) or considerably longer treatments at 400° F. (204° C.) or 600° F. (316° C.) made only relatively modest increases in the retention force. Thus, the time temperature relationship can be clearly optimized to create the largest increase in retention force. The useful range of temperature to obtain some benefit appears to be 500° F. (260° C.) to 1050° F. (566° C.) with a corresponding time range of ten hours to ten minutes at temperature.

Subsequent to the oxidizing heat treatment the heated part is allowed to cool and the interference fit parts assembled in the conventional manner. The time at temperature is very important to optimizing the increase in retention force. Excessive time at the optimum temperature builds up an oxide layer of excessive thickness resulting in a less than maximum retention force in the assembly. Although the method is directed to interference fit assemblies, the method is applicable where enhanced resistance to frictional slippage in a tight engagement between two surfaces is desired.

Other methods of creating or applying a surface layer of iron oxide of optimum thickness to an iron or steel part for interference fit assembly or tight engagement with limited frictional slippage may be used. Such methods as explosive or impact impingement of ceramic particles may be applied to bond iron oxide particles to the iron or steel substrate.

DESCRIPTION OF THE PREFERRED EMBODIMENTS

Figure 1:
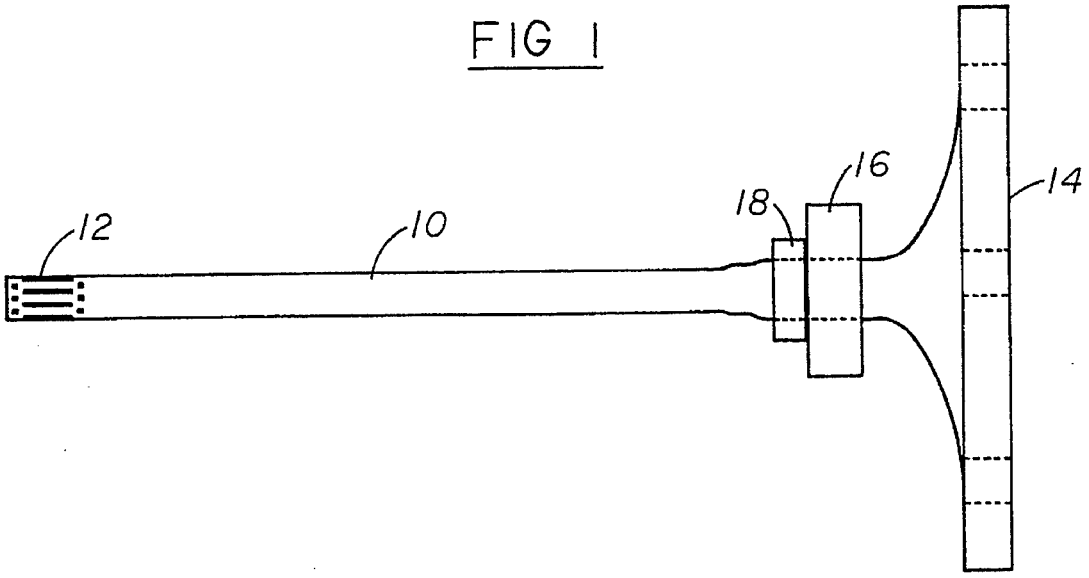
FIG. 1 is a side view of an automobile axle shaft bearing and locking collar assembly.
Figure 2:
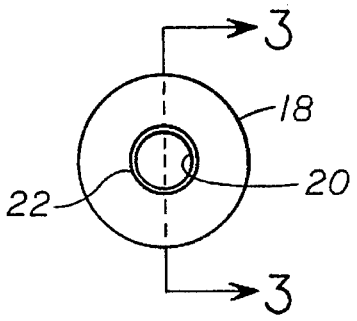
FIG. 2 is a face view of the locking collar of FIG. 1.
Figure 3:
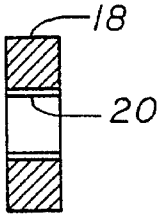
FIG. 3 is a cross-section view of the locking collar taken along the line 3—3 in FIG. 2.

Illustrated in FIG. 1 is a typical rear axle shaft 10 for an automobile or truck having a spline 12 at the inner end and a wheel flange 14 at the bearing end. An axle bearing 16 is shown on the shaft 10 adjacent the flange 14 and adjacent and inside the bearing 16 is a locking collar 18 interference fit onto the shaft 10.

As installed in a vehicle the locking collar 18 prevents the axle shaft 10 from moving rightwardly through the bearing 16. The spline 12 engagement with the differential (not shown) prevents the axle shaft 10 from moving to the left.

The interference fit of the locking collar 18 on the shaft 10 substantially increases the frictional force necessary to remove the collar once installed. Thus, the retention force generated by the interference fit arises from the combination of the friction forces between the collar and shaft surfaces in intimate contact and the squeezing force at this interface. The applicant has improved the retention forces between the collar and the shaft by purposely creating an oxide surface of limited thickness on at least one of the mutually engaging interference fit surfaces.

To increase this retention force the applicant has developed the following method of creating a carefully characterized oxide surface layer 20 on the collar 18 inner surface 22. The carefully formed oxide layer 20 apparently partially crushes during interference fit assembly, freeing and opening up fresh oxygen free microscopic metallic surfaces that then weld to increase the interface sliding friction. However, the mechanism by which the interface friction is increased is not completely understood.

A method by which the oxide layer is formed comprises heating an iron or steel part into a temperature range of approximately 500° F. (260° C.) to 1050° F. (566° C.) and holding the part at temperature for a time period of about ten hours to ten minutes depending upon the temperature. There is a time-temperature range that appears to provide the optimum increase in retention force for the interference-fit assembly. This temperature range is about 700° F. (371° C.) to 800° F. (427° C.) for an effective doubling of the retention force of the AISI 1541 steel collars. Apparently, both types of $Fe_2O_3$ or some combination of $\alpha$ $Fe_2O_3$ and $\gamma$ $Fe_2O_3$ are producing the optimum retention force, however, the exact mechanism is not known.

The initial program for testing the interference fit assemblies and the oxide layer forming methods comprised the treatment of a plurality of round collars at various time-temperature conditions followed by interference fit (0.008 inches approximately) assembly on a shaft and subsequent pressed disassembly to measure the engagement force and the retention force for each test specimen. The test results below may be compared with conventional collars typically having "push on" and "pull off" forces of less than ten thousand pounds. The invention, however, is not limited to collars on shafts but is applicable to a wide variety of assemblies with interference fit engagements between iron or steel parts. It is important, however, that the yield strength of the external part not be exceeded in the interference fit to assure that the squeezing force is retained. Therefore, the collars in the experimental tests were heat treated to above 1550° F. (843° C.) and oil quenched for hardening with the exception of one set of samples that was not hardened for comparison purposes. The representative results of the tests are summarized as follows:

AVERAGED TEST RESULTS

| | Hardness | Yield | Push-On # | Push-Off # |
|---|---|---|---|---|
| Hardened 700° F. Temper 2 hr. | 46.4 HRc | .00208 | 21,567 | 22,496 |
| Hardened 800° F. Temper 2 hr. | 40.6 HRc | .00184 | 19,600 | 23,175 |
| Hardened 900° F. Temper 2 hr. | 35.8 HRc | .00184 | 13,625 | 14,425 |
| Green 700° F. Temper 2 hr. | 92.5 HRb | N/A | 10,312 | 4,950 |

As indicated by the test results the "push-on" and "pull-off" forces for the hardened collars greatly exceed the typical values noted above of less than ten thousand pounds for hardened collars absent the new oxiding heat treatment. Conversely, the non-hardened collars were detrimentally affected. A minimum hardness of Rockwell "C" 10 appears to be necessary to prevent undue yielding and expansion of the collar.

As noted above excessive time at temperature causes an excessive build up of the oxide layer with a reduction of the retention force. While the precise reason the excessive build up of the oxide layer causes a reduction in retention force is not known, the brittleness of the oxide layer may be a factor. With treatment at 800° F. (427° C.) for two hours the optimum thickness of the oxide layer to maximize the retention forces is about 0.2 μm to 0.5 μm.

As a part of the test program, a chemically obtained black oxide layer on test collar specimens was compared with the other tests. The black oxide layer resulted in retention forces of less than ten thousand pounds. The explanation for the lower values of retention force with the chemical treatment may arise from the thickness or shear strength of the oxide being different from the oxide created by heating in air. Black iron oxide, $Fe_3O_4$, tends to act as a lubricant whereas $Fe_2O_3$ is a brittle ceramic abrasive that discourages frictional slippage.

Tests of applicant's specimens, heated in air to form the oxide layer, disclose an iron oxide surface layer of $Fe_2O_3$ with FeO and $Fe_3O_4$ almost undetectable. Thus, methods that generate an iron oxide layer of $Fe_2O_3$ are to be preferred to obtain the improved retention forces.

Thus, in summary the mere creation of an oxide layer is not sufficient to obtain the superior results of the invention. The method of obtaining the oxide is of great importance to the superior results.

I claim:

1. A mechanical assembly comprising:

a pair of components wherein a first of said components defines an aperture and a second of said components is adapted to be forcibly placed into said aperture for assembly and retention therein, said second component and said aperture being dimensioned to provide an interference fit relationship, and said first and second components each defining an engaging surface formed of iron or steel which are in intimate contact when said components are assembled, at least one of said engaging surfaces having an oxide surface layer formed thereon prior to engagement by heating said surface to a temperature between 500° and 1050° F., said oxide surface layer including $Fe_2O_3$ and having a controlled thickness enhancing retention of said first and second components when assembled in said interference fit relationship.

2. The mechanical assembly of claim 1 wherein said oxide surface layer comprises a microcrystalline combined of $\alpha$ and $\gamma$ Haematite formed by heating said at least one engaging surface to a temperature between about 500° F. and about 1050° F.

3. The mechanical assembly of claim 1 wherein said at least one engaging surface is retained at the elevated temperature for between about 10 minutes and 10 hours.

4. The mechanical assembly of claim 1 wherein said oxide surface layer is formed by heating said engaging surface in an oxidizing environment to about 700° F. to 800° F. for about two hours to maximize the retention of said assembly.

5. The mechanical assembler of claim 1 wherein at least one of said engaging surfaces is hardened steel.

6. The mechanical assembly of claim 1 wherein said controlled thickness is about 0.2 μm to 0.5 μm.

7. A mechanical assembly according to claim 1 wherein said first component comprises a collar in which said aperture is a round hole and said second component comprises a shaft in which said engaging surface is cylindrical having a diameter larger than the diameter of said hole.

8. A mechanical assembly according to claim 7 wherein said shaft diameter is about 0.008 inch larger than said hole diameter.

9. A mechanical assembly according to claim 7 wherein said engaging surface of said collar having said oxide surface layer and said shaft engaging surface being free of said oxide surface layer.

10. A mechanical assembly according to claim 1 wherein said oxide surface layer is substantially free of $Fe_3O_4$.

* * * * *